United States Patent [19]

Maeda et al.

[11] 3,937,267

[45] Feb. 10, 1976

[54] METHOD OF PREVENTING FIN OCCURRENCE DURING METAL CASTING

[75] Inventors: Ichiya Maeda, Nagano; Tsuneyoshi Kuroiwa, Suzaka, both of Japan

[73] Assignee: Kabushiki Kaisha Akita, Japan

[22] Filed: Jan. 3, 1974

[21] Appl. No.: 430,553

[52] U.S. Cl. ..... 164/47; 164/72

[51] Int. Cl.[2] ..... B22C 3/00

[58] Field of Search ..... 425/DIG. 58, DIG. 123; 164/235, 245, 364, 248, 369, 13, 14, 33, 45, 47, 70, 78, 140, 161, 7, 160; 249/153, 52; 264/162, 161

[56] References Cited

UNITED STATES PATENTS

| | | | |
|---|---|---|---|
| 821,997 | 5/1906 | Exton | 164/248 |
| 2,540,457 | 2/1951 | Rice | 425/DIG. 123 |
| 2,629,907 | 3/1953 | Hugger | 164/14 |
| 3,424,425 | 1/1969 | Holtkamp | 425/DIG. 58 |
| 3,552,480 | 1/1971 | Harris | 164/245 |
| 3,565,163 | 2/1971 | Owen | 164/364 X |
| 3,570,585 | 3/1971 | Harris | 164/45 X |

*Primary Examiner*—Francis S. Husar
*Assistant Examiner*—John S. Brown
*Attorney, Agent, or Firm*—Holman & Stern

[57] ABSTRACT

Prevention of fins during a metal casting process is achieved by employing a mold having at least one protuberance along a parting line of the mold and a film of soft plastic covering the mold including the protuberance. When the mold is pressed against another mold the protuberance is held in place by the film of soft plastic. The pattern for forming the mold includes a shielding mold member of a soft plastic film formed over an inversely drafted part along a parting line of the pattern. The mold can also be formed from a pattern having a shielding mold member of a soft plastic film formed over at least one recess in a parting line of the pattern.

1 Claim, 9 Drawing Figures

METHOD OF PREVENTING FIN OCCURRENCE DURING METAL CASTING

CROSS-REFERENCE TO RELATED APPLICATION

This invention relates to a method and a pattern for preventing a fin from occurring during metal casting, especially in a molding method in which a mold in maintained under a vacuum force. The present invention is an improvement of the molding method disclosed in commonly assigned U.S. pat. application Ser. No. 182,476 filed Sept. 21, 1971 and now U.S. Pat. No. 3,789,907.

BACKGROUND OF THE INVENTION

Since the occurrence of fins requires after-treatment processes of a molded article, it decreases the working efficiency of the molding process and pollutes the environment undesirable.

In accordance with a convention molding method, especially in which a cavity is formed by connecting molds, the molds are pressed against each other in order that the melt does not spill through the parting portions when pouring, and the parting surfaces are formed as flat as possible, so that each mold may be connected completely.

But it is nearly impossible to produce an article without fins, because as the sand is bare along the parting lines, in case of pressing the molds too hard, the sand near the parting lines may be broken down into a cavity.

SUMMARY OF THE INVENTION

According to the present invention, a mold is covered with a thin film of soft plastic and has protuberances along its parting lines, and the protuberances are squashed when the molds are connected and completely fitted against each other. In this case, the protuberances are never broken down into the cavity, because of the covering by said plastic film.

An object of the present invention is to provide a method for producing an article without fins for increasing the working efficiency of a molding process.

Another object of the present invention is to provide a pattern for executing the method mentioned above.

BRIEF DESCRIPTION OF THE DRAWINGS

Other objects and advantages will become more readily apparent from the following detailed description when read in connection with the accompanying drawings, in which.

DETAILED DESCRIPTION OF PREFERRED EMBODIMENTS

One embodiment of the present invention will be described with reference to FIGS. 1 to 4.

Figure 1:
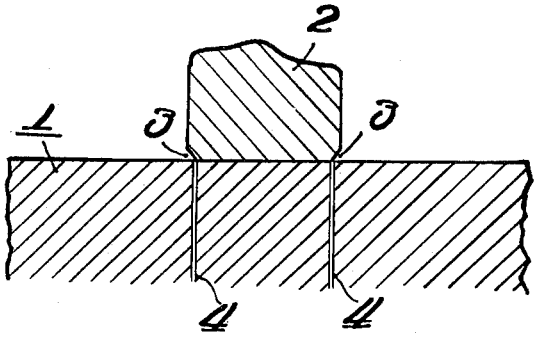
FIG. 1 is a sectional view of a part of a pattern.

In FIG. 1 of the drawings, 1 is a pattern with a portion 2 for forming a cavity, an inversely drafted part 3 along a parting line thereof and some small vent ports 4 for drawing a shielding mold member toward the surface of the pattern 1.

A heated shielding mold member 5 made of a thin film of soft synthetic resin is drawn into intimate contact with said pattern 1 by suction through the small vent ports 4 of the pattern 1. Then the shielding mold member 5 is formed along the pattern 1 so as to form the same shape as the pattern 1 as shown in FIG. 2.

Figure 2:
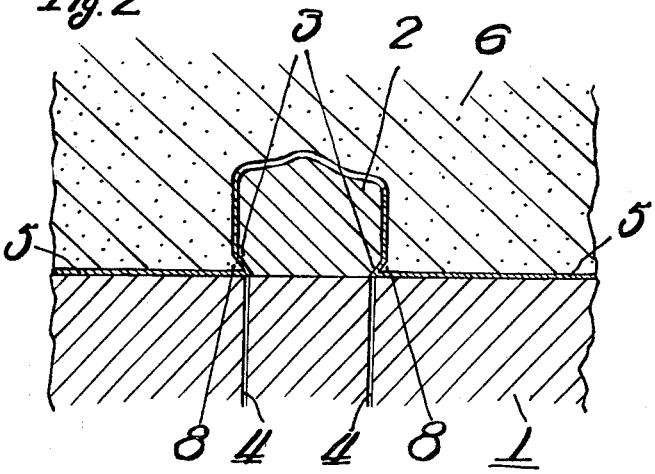
FIG. 2 is a sectional view of a part of a shielding mold member adhered to the pattern and molding sand filled on the shielding mold member.

A flask (not shown) connected to an evacuation means is placed on the pattern 1, and is filled with molding sand 6 as shown in FIG. 2, and then said flask is covered by sealing materials, such as a plastic film (not shown).

The inside of the flask is evacuated to make the air pressure lower than on the outside of the flask.

Figure 3:
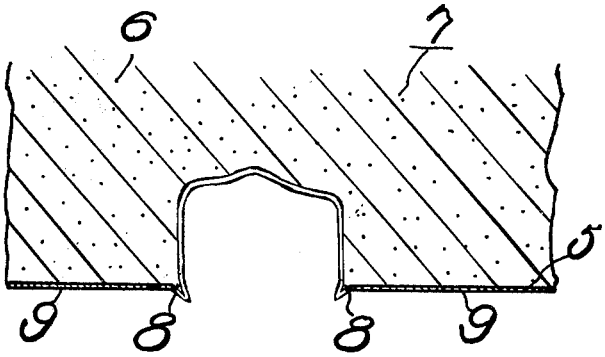
FIG. 3 is a sectional view of a main part of a mold.

After application of the vacuum to the pattern 1 is stopped, the pattern 1 is removed from the shielding mold member 5, thereby forming a mold 7. At this time, protuberances 8 which were formed by the inversely drafted part 3 of the pattern 1 are changed to almost at right angles to the parting surface 9 as shown in FIG. 3.

Figure 4:
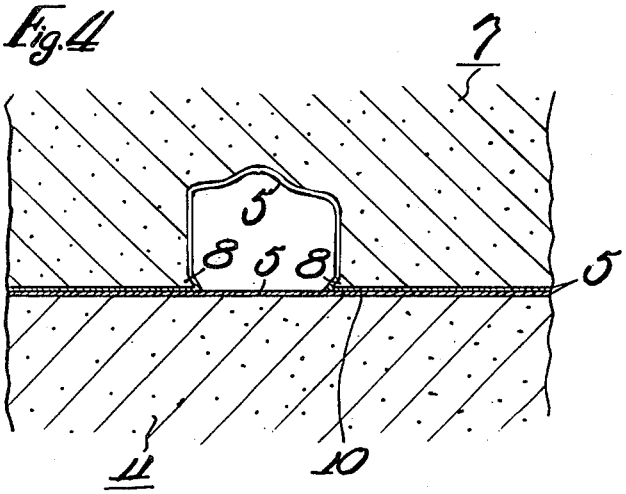
FIG. 4 is a sectional view of a main part of connected molds for forming a cavity.

The protuberances 8 of said mold 7 are pressed and adhered closely to a surface 10 of the other mold 11 when the molds 7 and 11 are clamped as shown in FIG. 4.

Hereinafter, the other embodiment of the present invention is described with reference to FIGS. 5 to 9.

Figure 5:
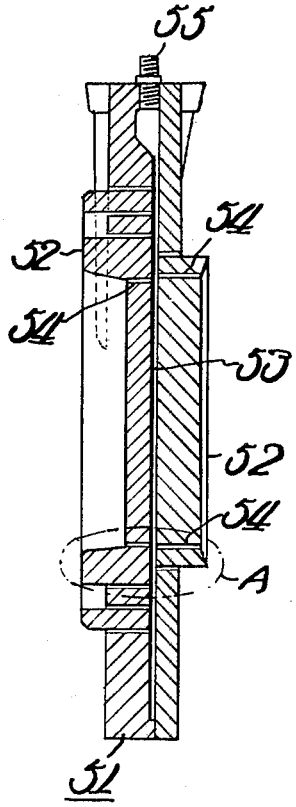
FIG. 5 is a sectional view of a pattern of the other embodiment of the present invention.
Figure 6:
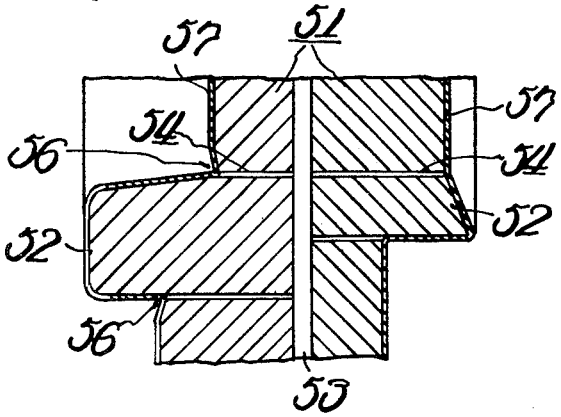
FIG. 6 is an enlarged sectional view of a main part (A) of the pattern shown in FIG. 5.
Figure 7:
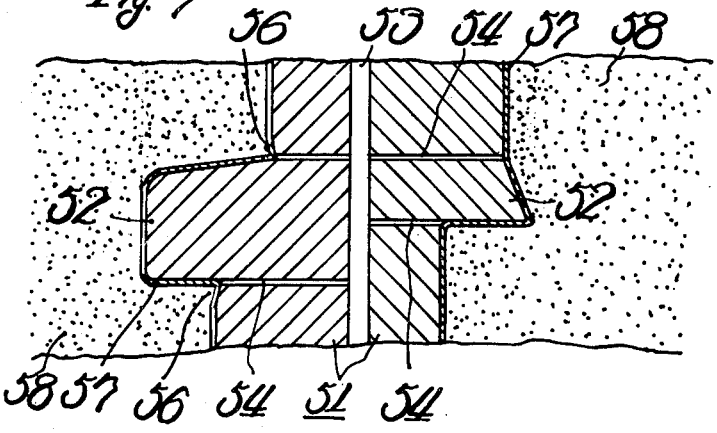
FIG. 7 is an enlarged sectional view of a main part (A) of the shielding mold members drawn by vacuum force to the pattern in FIG. 5.

In FIG. 5 of the drawings, 51 is a pattern with portions 52 for forming a cavity on both sides thereof, having a cavity 53 communicated through a small suction port 54 with said portions 52 and connected to an evacuating port 55, and furthermore, as shown in FIG. 6, a recess 56 of about 0.5 mm in depth and about 1mm – 2mm in width is formed in a parting line of said pattern 51.

Now as shown in FIG. 6, using the pattern 51 mentioned above, a shielding mold member 57, for example a, soft plastic film of 0.02mm – 0.1mm in thickness is adhered to the pattern 51 by suction through said small suction ports 54, and then the shielding mold member 57 is formed on the pattern 51 so as to form the same shape as the pattern 51.

A flask (not shown) connected to an evacuation means (not shown) is placed on the pattern 51, and is filled with molding sand 58, and then said flask is covered by sealing materials, such as a plastic film. The inside of the flask is evacuated to make the air pressure lower than on the outside of the flask.

Figure 8:
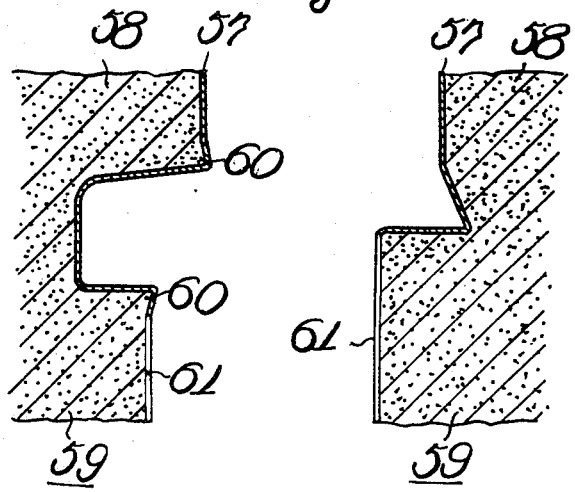
FIG. 8 is an enlarged sectional view of the main part of the molds which are made by the main part (A) of the pattern in FIG. 5.

After application of the vacuum to the pattern 51 is stopped, the pattern 51 is removed from the shielding mold member 57, thereby forming molds 59 having protuberances 60 which were formed by recesses 56 of the pattern 51 as shown in FIG. 8. The protuberances 60 are pressed by each mold 59 and connected closely together by surfaces 61 of the molds.

It will be understood that each of the elements described above, or two or more together, may also find a useful application in other types of molding arrangements differing from the types described above.

While the invention has been illustrated and described as two embodiments, it is not intended to be limited to the details shown, since various modifications and structural changes may be made without departing in any way from the spirit of the present invention.

Figure 9:
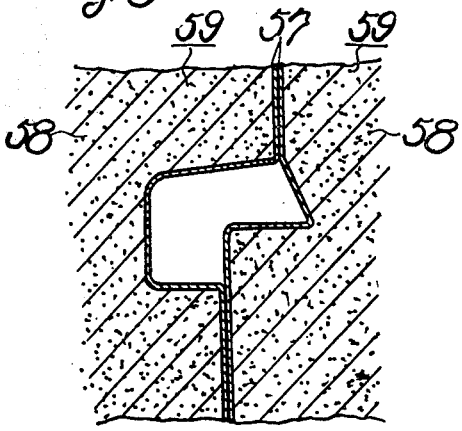
FIG. 9 is an enlarged sectional view of a cavity formed by the molds shown in FIG. 8.

Thus in accordance with the present invention, since the molds are covered by the shielding mold members members which are made of thin films of soft plastic, and maintained by vacuum force, the parting lines are perfectly fitted against each other and the protuberances along the parting lines are squashed, when the molds are pressed so as to form a cavity as shown in FIGS. 4 and 9, thereby making it possible to obtain a very fine article without fins.

What is claimed is:

1. A method for preventing a fin from occurring during metal casting comprising: providing a mold having a recess therein with a protuberance extending completely around the periphery of the recess and outwardly beyond the parting line of the mold and a film of soft plastic covering the mold including the protuberance; pressing the mold against another mold to form a cavity and squash the protuberance, the protuberance being held by the plastic film; preparing a melt of a metal; and casting the melt into the cavity.

* * * * *